US005678630A

United States Patent [19]

Shaw et al.

[11] Patent Number: 5,678,630

[45] Date of Patent: Oct. 21, 1997

[54] DIRECTIONAL DRILLING APPARATUS

[75] Inventors: Ronald L. Shaw, Youngsville; Clyde J. Cormier, Church Point, both of La.

[73] Assignee: MWD Services, Inc., Youngsvulle, La.

[21] Appl. No.: 635,739

[22] Filed: Apr. 22, 1996

[51] Int. Cl.[6] ..... E21B 17/10; E21B 47/12

[52] U.S. Cl. ..... 166/241.4; 166/242.6; 175/50

[58] Field of Search ..... 166/50, 313, 117.6, 166/241.4, 241.5, 241.6, 242.6; 175/50

[56] References Cited

U.S. PATENT DOCUMENTS

| | | | |
|---|---|---|---|
| 4,169,505 | 10/1979 | Neal | 166/117.5 |
| 4,194,561 | 3/1980 | Stokley et al. | 166/241.6 X |
| 4,325,438 | 4/1982 | Zuvela | 175/50 |
| 4,790,380 | 12/1988 | Ireland et al. | 175/50 X |
| 5,353,872 | 10/1994 | Wittrisch | 175/50 X |
| 5,495,237 | 2/1996 | Yuasa et al. | 175/50 X |
| 5,507,348 | 4/1996 | Van Steenwyk et al. | 166/241.5 X |

*Primary Examiner*—Frank Tsay
*Attorney, Agent, or Firm*—John D. Jeter

[57] ABSTRACT

A well bore communication pulser in a shuttle package is arranged to aid in stabbing the package into the muleshoe receiving bore in the drill string, especially when the muleshoe is located in a drill string bore larger than the upwardly continuing bore of the drill string from which the package arrives when being installed. The shuttle package is provided with at least two elastomer centralizers separated along its length with the lower one just above the muleshoe after the package is stabbed into its bore. When the drill string is inclined relative to vertical the package sags in the span between the centralizers. The sag lifts the lower end of the package toward the drill string centerline by fulcrum action of the lower centralizer.

9 Claims, 1 Drawing Sheet

DIRECTIONAL DRILLING APPARATUS

This invention pertains to equipment related to well bore drilling activity typically applied in the petroleum industry. More specifically it pertains to hardware related to Measurement While Drilling (MWD) activity with a shuttle packaged pulse generator movable along the drill string bore for installation and recovery. The apparatus disclosed aids in aligning the pulser with a receiving muleshoe bore, especially when the drill string is not vertical.

BACKGROUND OF THE INVENTION

Pulse generators have been used in the petroleum well drilling industry for many years to respond to down hole instruments to operate a signal valve in the drill string to vary the resistance to the flow of drilling fluid moving down the drill string bore. They generate pressure changes, often called pulses that are detectable in the drilling fluid circuit at the surface. The pulses usually have a time spaced encoding that is detected and decoded at the surface to represent the information produced by the down hole instrument. Early successful pulsers simply indicated turbo-drill speed. More recently the pulses transmitted from down hole contain information related to well logging, steering, formation resistivity, well bore survey, and the like.

Pulse generators sometimes fail in less time than a bit run and a system has evolved to prevent tripping the string prematurely for repairs. To recover the pulser between bit runs the concept of the shuttle package evolved. The shuttle package is movable along the drill string bore and is recoverable by a wire line rather quickly run down the string bore from the surface. The shuttle contains the down hole instruments, batteries, and the pulse generator. To orient the package with the drill string a muleshoe arrangement is usually provided and carried by the drill string. Getting the pulser into the bore of the muleshoe when it is run back in, usually by the wire line, is no problem if the drill string is vertical. If the drill string is not vertical, and that is becoming the usual case, the shuttle tends to lay on the low side of the string bore. To accommodate the drilling fluid flow around the muleshoe suspension structure the string bore in its vicinity is usually enlarged. That allows the shuttle to lie more off-center and adds to the problem. If the pulser utilizes a lower end signal valve popper it is usually blunt on the end and stabbing it into the muleshoe bore is often uncertain.

The usual shuttle package is about one and one-half inches in diameter and often twenty feet long resulting in a quite flexible assembly relative to the massive drill string. Centralizers, normally elastomeric, are needed to prevent shock to sensitive sensors when the package impacts the string bore wall while drilling progresses. Such centralizers are often round rubber fingers projecting radially from structure separating the battery pack and the instrument pack, and often one centralizer is placed on the top terminal structure that carries the common overshot recovery spear. The lower end of the package of the type addressed herein contains the mechanism that powers and controls the signal valve, which can define the pulser portion of the package. Centralizers are not currently used on that portion because it is stabbed into the muleshoe receiving bore and the centralizer is without function after such stabbing occurs. The structure just above the pulser is subject to bending loads due to the stiffness of the muleshoe structure relative to the overall package being supported and there is a reluctance to drill holes for centralizer fingers even to protect the package while it is traveling down the drill string bore.

It has been found that a radially stiff centralizer located about one fifth of the package length from the lower end of the package and a second centralizer within one foot of the upper end cooperate to align the lower end of the package with a central muleshoe receiving bore. The effect is not hampered by mid package centralizers if they are of smaller diameter than the drill string bore occupied during the stabbing process. The mid package sag increases as the angle from vertical increases and the amount of compensation due to the fulcrum action of the lower centralizer increases as needed.

There is a need for a fulcrum centralizer at the lowest point practical on the package to aid in stabbing the package into the muleshoe receiving bore. If the centralizer is molded onto the pulser structure the structure is not appreciably weakened by the presence of the molded centralizer.

It is therefore an object of this invention to provide an elastomeric fulcrum centralizer molded on to the pulser structure and positioned axially to be just above the muleshoe when the shuttle package is finally in position for service.

It is another object of this invention to provide axial spacing between centralizers on a shuttle package to cause sag of the package between the centralizers, in combination with a fulcrum centralizer near the lower end of the package, to lift the lower end toward the drill string bore centerline to aid in stabbing the package into the bore.

These and other objects, advantages, and features of this invention will be apparent to those skilled in the art from a consideration of this specification, including the attached claims and appended drawings.

SUMMARY OF THE INVENTION

A well bore communication pulser in a shuttle package is arranged to aid in stabbing the package into the muleshoe receiving bore, especially when the muleshoe is located in a drill string bore larger than the upwardly continuing bore of the drill string from which the package arrives when being installed. The shuttle package is provided with at least two elastomer centralizers separated along its length with the lower centralizer just above the muleshoe after the package is finally stabbed into the muleshoe receiving bore. When the drill string is inclined relative to vertical the package sags in the span between the centralizers. The sag lifts the lower end of the package toward the drill string centerline by fulcrum action of the lower centralizer. The desired effect has been found to be optimized if three-fourths of the package length is between the upper centralizer and the lower fulcrum stabilizer. The upper centralizer can be as near as practical to the very top of the package.

BRIEF DESCRIPTION OF DRAWINGS

In the drawings wherein like features have similar captions.

DETAILED DESCRIPTION OF DRAWINGS

For descriptive clarity, some details are omitted from the drawings if they are well established in the art and have no bearing upon the points of novelty. Such omitted details may include bearing details, seal details, elastomer bond lines, and the like.

Figure 1:
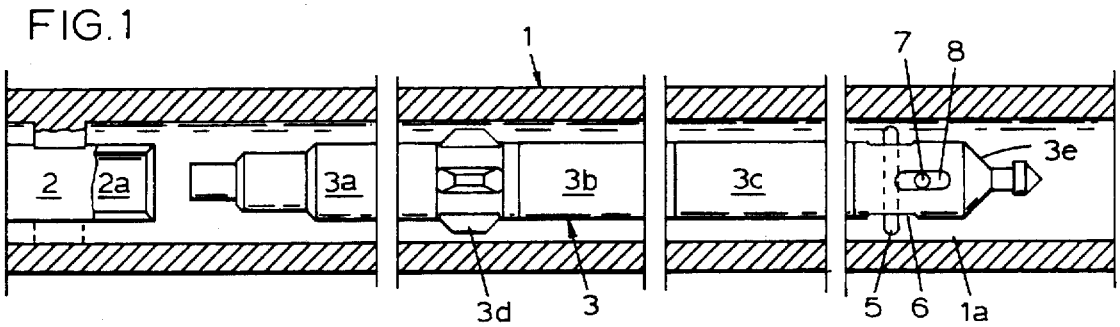
FIG. 1 is side elevation of the shuttle package approaching the lower end of the drill string, which is sectioned.
Figure 2:
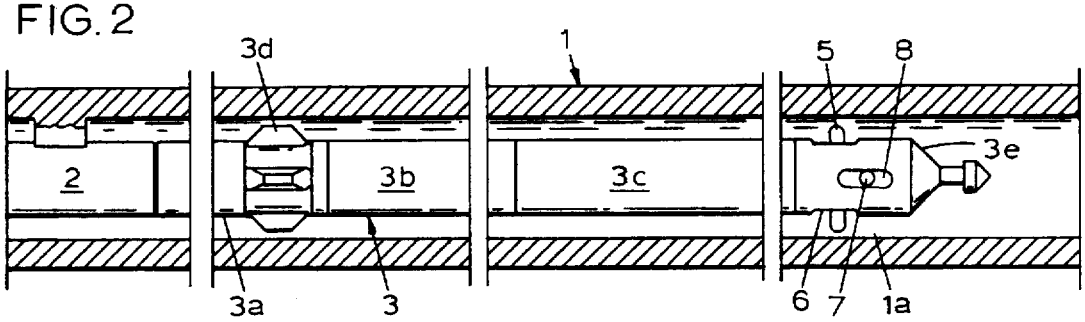
FIG. 2 is similar to FIG. 1 with the shuttle package stabbed into the muleshoe receiving bore, the final position.

In FIG. 1 the drill string 1 has bore 1*a* continuing from the surface along which shuttle package 3 moves during installation and recovery. The bore is often somewhat enlarged in the non-magnetic collar below the major length of drill string. A muleshoe 2 with bore 2*a* opening upward is located near the lower end of the drill string in the bore 1*a*. The shuttle package consists, at least, of the pulser 3*a* connected to the battery pack 3*b* which is further connected to the instrument pack 3*c*, with a top terminal 3*e* for the overshot spear for wire line attachment and the novel centralizer 3*d* molded onto the pulser portion of the package. The instrument portion and the battery pack are sometimes switched. The cenralizer on terminal 3*e* is old art of common form. It has rubber fingers 5 and 7 usually situated in holes that extend through the structure of the terminal. Recesses 6 and 8 allow the fingers to collapse for the package to pass through tight bores in the drill string. If two finger units are used as shown they are radially distributed at right angles. Finger cenralizers are sometimes used on a spool between packs 3*b* and 3*c*. Such fingers, if otherwise usable on the pulser, might not provide enough stiffness to serve as a fulcrum to support the lower end of the package for stabbing purposes if the drill string is considerably tilted relative to vertical. FIGS. 1 and 2 are shown as vertical with the left end down. In the off vertical situation the package will lie on the low side of the bore and the blunt lower end of the package will hit the rim of the muleshoe bore and stabbing the package into bore 2*a* may not be successful. The package 3 sags between the centralizers toward a bore low side and lifts the lower end of the package, using the lower centralizer as a fulcrum, to align the lower end of the package with bore 2*a*.

FIG. 2 shows the same assembly as FIG. 1 after the lower end of the pulser is stabbed into the muleshoe bore. The centralized 3*d* no longer serves a centralizer function.

Figure 3:
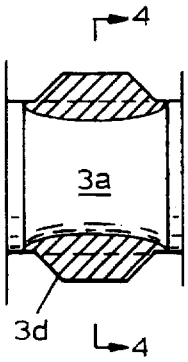
FIG. 3 is a side elevation of the novel centralizer with the centralizer sectioned.

FIG. 3, partly cut away, shows the centralizer 3*d* molded on to the structure of the pulser portion 3*a*. The pulser structure is only slightly reduced is section area for the molding of the centralizer, which is sectioned.

Figure 4:
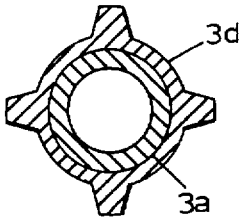
FIG. 4 is a section of FIG. 3 taken along line 4.

FIG. 4 is a section along line 4 of FIG. 3. This shows a cruciform configuration. Star shape or six blades are to be used on larger installations. The bore shown through structure 3*a* is symbolic and differs with pulser configurations in use.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the tool of this invention without departing from the scope thereof, it is to be understood that all matter herein set forth or shown in the accompanying drawings is to be interpreted as illustrative and not in a limiting sense.

The invention having been described, I claim:

1. A directional drilling apparatus to aid in stabbing a shuttle packaged measurement while drilling pulser into a receiving bore of a muleshoe situated near the lower end of a drill string, the apparatus comprising:

a) an elongated generally cylindrical shuttle package for movement along a drill string bore comprising at least a pulser pack, an instrument pack, and a battery pack with means at the lower end for stabbing into the receiving bore;

b) a centralizer near the upper end of said package comprising a plurality of radially extending projections;

c) a fulcrum centralizer located near the lower end of the package;

whereby said fulcrum centralizer serves to urge the lower end of said package toward the centerline of said bore until the lower end of said package is stabbed into said bore.

2. The apparatus of claim 1 wherein said fulcrum centralizer provides a plurality of elastomeric projection extending radially from a generally cylindrical body molded to said pulser pack.

3. A directional drilling apparatus to aid in stabbing a shuttle packaged measurement while drilling pulser into a receiving bore of a muleshoe situated near the lower end of a drill string, the apparatus comprising:

a) an elongated generally cylindrical shuttle package for movement along a drill string bore comprising at least a pulser pack, an instrument pack, and a battery pack with means at the lower end for stabbing into the receiving bore;

b) a plurality of axially spaced centralizers on said package each with a plurality of peripherally distributed radially extending elastomeric projections to space said package some distance from the drill string bore, said centralizers spaced to provide one on the lower one fifth of the package length and one on the top one tenth of the package length.

4. The apparatus of claim 3 wherein said centralizer near the lower end of said package is formed as a molded composite bonded to the structure of said pulser pack.

5. A directional drilling apparatus to aid in stabbing a shuttle packaged measurement while drilling pulser into a receiving bore of a muleshoe situated near the lower end of the bore of a drill string, the apparatus comprising:

a) an elongated generally cylindrical shuttle package for movement along the drill string bore comprising at least an instrument pack, a battery pack, and a pulser pack at the lower end, with means at the lower end of said pulser pack for stabbing said package into the receiving bore;

b) an upper centralizer situated along the upper tenth of the package length and comprising a plurality of peripherally distributed radially extending projections to urge said package away from the bore of said drill string;

c) an elastomeric fulcrum centralizer bonded to the structure of said pulser pack with a plurality of peripherally distributed radially extending projections to bear against the bore of said drill string to space said package from said wall at least until said package is stabbed into said bore.

6. The apparatus of claim 5 wherein said fulcrum centralizer is located along the lower one fifth of the package length.

7. The apparatus of claim 5 wherein any centralizers situated between said upper centralizer and said fulcrum centralizer are of less diameter than said fulcrum centralizer.

8. The apparatus of claim 5 wherein said fulcrum centralizer is bonded by the polymerization process of molding elastomer material on the supporting metal structure.

9. The apparatus of claim 5 wherein said fulcrum centralizer is bonded to the metal structure of the pulser by adhesive.

* * * * *